US005526623A

United States Patent [19]

Bullivant

[11] Patent Number: 5,526,623

[45] Date of Patent: Jun. 18, 1996

[54] STRUCTURAL BEAMS

[75] Inventor: Roger A. Bullivant, Burton-on-Trent, United Kingdom

[73] Assignee: Roxbury Limited, Gilbralter, England

[21] Appl. No.: 389,133

[22] Filed: Feb. 14, 1995

[30] Foreign Application Priority Data

Feb. 19, 1994 [GB] United Kingdom ..... 9403201
Aug. 25, 1994 [GB] United Kingdom ..... 9417148

[51] Int. Cl.[6] ..... E02D 27/00; E04B 5/18

[52] U.S. Cl. ..... 52/338; 52/274; 52/294; 52/322; 52/611; 405/229; 405/233

[58] Field of Search ..... 52/274, 292, 294, 52/299, 259, 319, 320, 322, 325, 338, 600, 602, 608, 609, 611, 721.1, 724.1, 737.1, 236.7, 236.8, 236.9; 405/229, 233

[56] References Cited

U.S. PATENT DOCUMENTS

| | | | |
|---|---|---|---|
| 1,796,306 | 3/1931 | Ruderman et al. | 52/609 X |
| 1,934,317 | 11/1933 | Mellmann | 52/724.1 X |
| 3,425,175 | 2/1969 | Gerde | 405/229 X |
| 3,802,134 | 4/1974 | McCorvey | 52/299 X |
| 4,163,621 | 8/1979 | Huguchi | 405/255 |
| 4,275,538 | 6/1981 | Bounds | 52/299 |
| 4,565,044 | 1/1986 | Takahara | 52/294 X |
| 4,569,173 | 2/1986 | Hultquist | 52/294 X |
| 4,754,588 | 7/1988 | Gregory | 52/294 |
| 4,837,991 | 6/1989 | Shaw | 52/274 X |
| 4,942,707 | 7/1990 | Huettemann | 52/259 |
| 4,998,393 | 3/1991 | Baena | 52/274 X |
| 5,070,672 | 12/1991 | Bullivant | 405/229 X |
| 5,217,326 | 6/1993 | Bullivant | 52/294 X |

FOREIGN PATENT DOCUMENTS

| | | | |
|---|---|---|---|
| 244557 | 1/1966 | Austria | 52/325 |
| 0528578A1 | 2/1993 | European Pat. Off. . | |
| 379204 | 8/1932 | United Kingdom . | |

*Primary Examiner*—Carl D. Friedman
*Assistant Examiner*—Kevin D. Wilkens
*Attorney, Agent, or Firm*—W. Thad Adams, III

[57] ABSTRACT

A pre-cast reinforced concrete structural beam comprises an upstanding web (136) and at least an inwardly directed flange (138) at the base of the web, the face of the web which is innermost in use and/or the upper face of the flange having surface irregularities (236,140) formed therein into which a cast in situ floor slab can penetrate to form a mechanical lock with the beam.

12 Claims, 2 Drawing Sheets

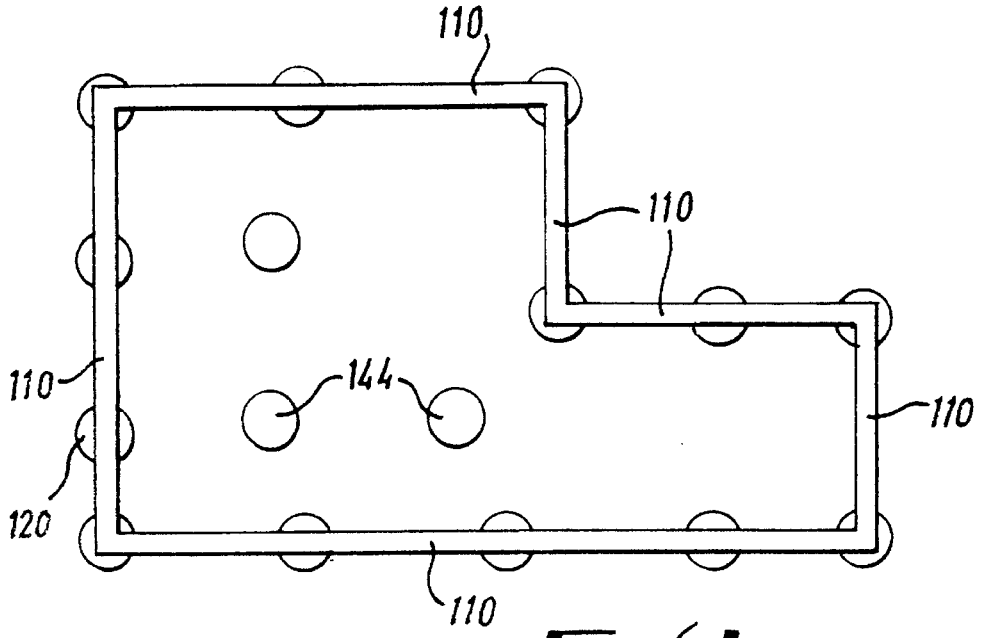
FIG. 1
FIG. 2
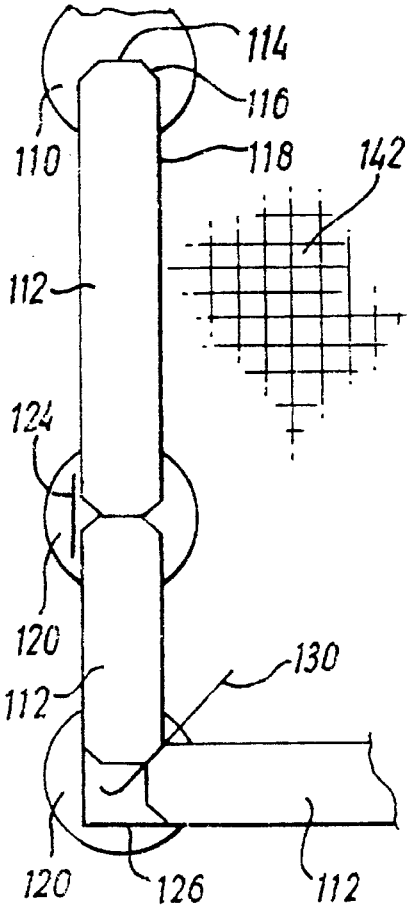
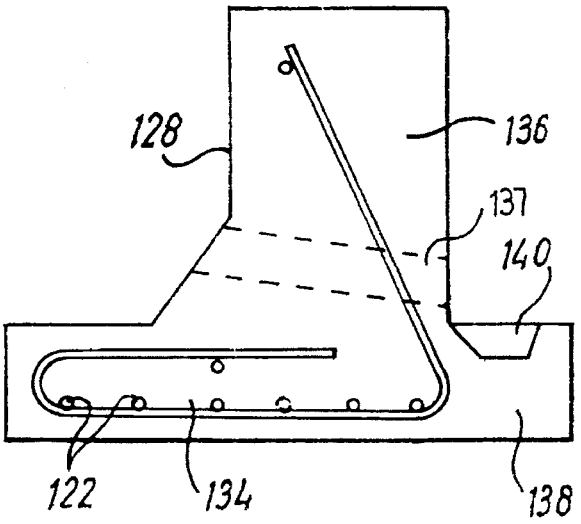
FIG. 3

STRUCTURAL BEAMS

The present invention concerns improvements in or relating to structural beams, especially but not exclusively structural beams for use in creating a foundation assembly for a building structure.

Our co-pending European Patent Application No. 0528578A discloses a support structure for a building in which a plurality of support members, for example piles, are placed in the ground and the gap between adjacent piles spanned by a prefabricated reinforced concrete structural beam on which the walls of the structure are built and the floor of the structure supported.

The floor structure described in our earlier European Patent Application is fabricated from a plurality of flooring beams, the gaps between each of which are filled with flooring blocks, this assembly subsequently being covered by a screed which is spread over the beam and block structure after assembly.

An alternative method of floor assembly which, in a number of instances, exhibits certain advantages, comprises casting a reinforced concrete floor in situ with the beams resting piles on or other support structures, defining the periphery of the building structure and acting as shuttering for the floor slab. The slab can be of any convenient construction. It may be cast, for example on polystyrene members resting on the ground within the structure and can include, as desired, reinforcing elements, heating elements, service ducts etc. As the floor slab does not Form part of the present invention it will not be described in detail in this specification.

It has been realised after detailed research and experimentation that the building structure is more efficient if the peripheral beams and floor structure act as a monolithic mass so that it is important that there is good mechanical interconnection between the beams and floor slab.

Proposals have been put forward in the past to achieve a good mechanical interconnection between the beam and the floor slab by providing that reinforcing steel within the beam projects outwardly so that it is cast in with the floor slab. Whereas this proposal is mechanically and structurally sound it gives rise to certain disadvantages, particularly during the manufacture and placement of the beams.

It is an object of the present invention to obviate or mitigate this and other disadvantages.

According to the present invention there is provided a structural beam comprising an upstanding web and a flange at the base of the beam extending transversely of the web to at least one side of the beam, at least one of the face of the web intended in use to face the interior of the structure to be built on the beam and the upper face of the flange including surface irregularities whereby a slab cast against said surface of the beam is keyed against movement relative to the beam by the surface irregularities.

Preferably the surface irregularities provided in the face of the web intended to face the interior of the structure comprise a plurality of ridges extending in a direction from the top to the bottom of the beam.

Preferably flanges are provided on both sides of the web, the flange which, in use, is intended to be innermost having a surface irregularity in the form of a channel formed in its upper surface.

Preferably transversely extending partitions are formed at spaced intervals across the channel.

Preferably a fillet is formed at the junction of the web and the flange which is intended to be outermost in use.

Preferably reinforcement is provided within the beam and comprises a plurality of longitudinal extending members and a plurality of transverse link members each of which comprises a first horizontal section extending into the flange which is outermost in use, a radiused section in said outermost flange, a lower section extending across the base of the Flange from said radiused section to a further radiused section interconnecting the base section with an upright section extending towards the top of the web at an angle to the vertical.

Preferably the longitudinal members are arranged against the upper and lower horizontal sections and the inclined upright section.

Preferably the length of the flange which is outermost in use is greater than that which is innermost in use.

Another aspect of the present invention provides a building structure comprising a structural beam assembly comprising a plurality of beams of the type described in any of the preceding eight paragraphs arranged around the periphery of the structure, support means located in the ground and supporting the ends of the beams, sacrificial shuttering for a floor slab covering the area enclosed by the beam assembly and a east in situ floor slab of a settable material covering the shuttering and contacting at least one of the inner face of the web of the beam and the upper face of an inwardly directed flange of the beam.

Preferably at the intersection between the beams there is placed a tie member extending inwardly. Preferably shuttering is placed at each joint between beam sections and concrete is cast into any void created by the facing ends of the beams and the shuttering.

Preferably the sacrificial base shuttering member defines a plurality of channels extending in generally mutually perpendicular directions.

Preferably reinforcing members are placed in each channel before concrete is poured therein.

An embodiment of the present invention will now be described by way of example only with reference to the accompanying drawings, in which:

FIG. 1 is a plan of a building structure;

FIG. 2 shows a corner detail from the plan;

FIG. 3 shows a cross-section through a first form of prefabricated, reinforced, concrete beam forming a foundation for a building structure;

Figure 4:
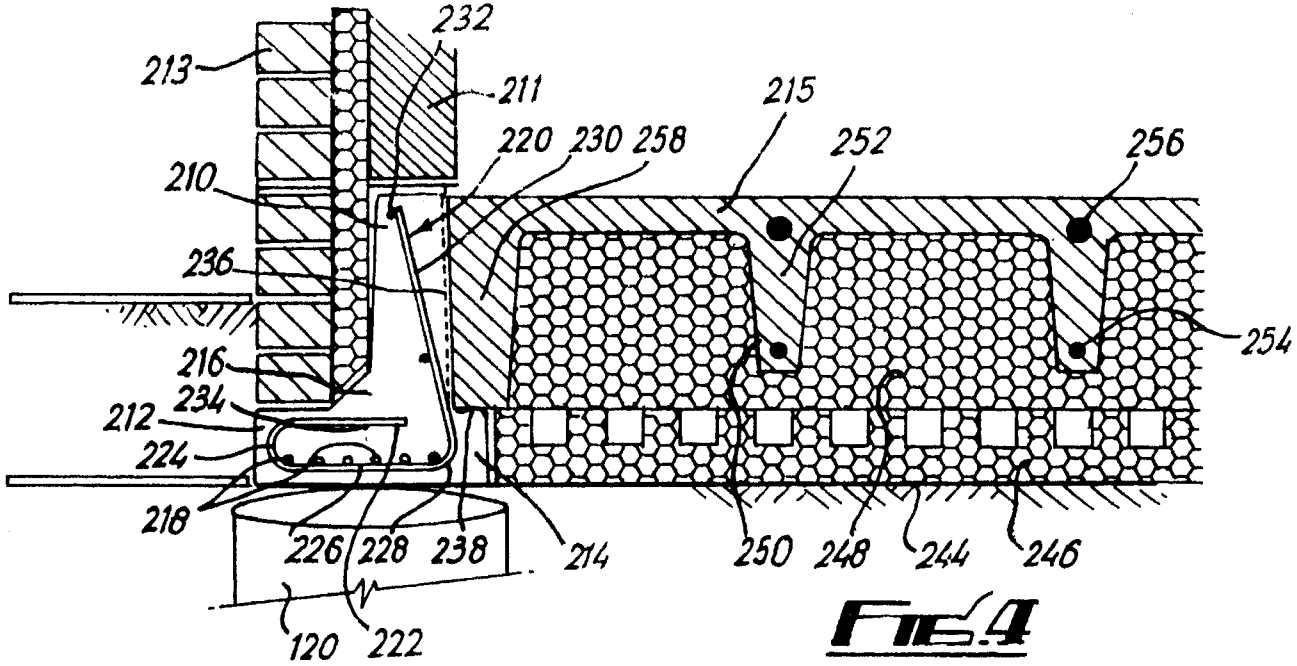
FIG. 4 shows a cross-section through a second form of beam at the edge of a building structure.

FIG. 1 shows diagrammatically a plan of a foundation assembly comprising peripheral inverted T-section beams 110. Each beam is supported on a ground engaging support member which may take any convenient form, for example, a pile with a cap thereon or a vertical foundation member of the type disclosed in our pending Patent Co-operation Treaty Application PCT/GB94/00116. As the support members do not form part of the present invention it will not be described in detail.

Each beam 110 comprises a plurality of beam sections 112 as illustrated in FIG. 2. The beam sections are manufactured in factory conditions. Each beam is an inverted T-shape cross-section and may be of the form illustrating FIG. 3. The end of each section is formed so that the beams can be laid in end-to-end relationship or transverse relationship to form corners or intersections. Each end is provided with a central transverse portion 114 and two backwardly sloping side portions arranged at angles of 45° extending between the central portion 114 and the beam longitudinal sides 118.

When a plurality of beam sections 112 have been laid on support members to form a beam 110 and an adjacent beam 110 has been laid, temporary shuttering 126 can be placed at the junction between the beam sections 112 and at corners, For example, straight shuttering 124 and right angled shuttering 126. The shuttering has a profile corresponding to the profile of the face 128 (FIG. 3) of the beam which is outermost in use. Tie members of reinforcing bar 130 are incorporated at the corners and project into the building structure as illustrated in FIG. 2.

FIG. 3 shows a typical beam section and comprises a base flange 134 and an upstanding web 136 each of which incorporates reinforcing members 122. The inner or first flange 138 of the base Flange 134 is provided with an open-topped channel 140 formed in its upwardly facing surface. An air passage 137 may be provided through the beam.

When the beam sections have been located and gaps therebetween filled with concrete a floor slab is cast in the area the beams define, the slab extending onto the upper surface of the flange 138 of the beam, the open topped channel 140 being filled with concrete to key the slab to the flange of the beam thereby preventing outward transverse movement of the beam. The slab is normally cast on sacrificial polystyrene slabs above which is supported a dual-spanning reinforcement lattice or mesh 142. After the concrete is set there is provided a composite homogeneous structure comprising the dual-spanning reinforced slab and peripheral beams, the homogeneous structure being supported on the support members 120.

It will be realised that as a result of the inherent strength of the floor slab, the load bearing characteristics of which are transmitted by way of the beams to the support members, it is not critical that the support members are placed below load bearing points, For example, internal walls. The load can be transmitted from the wall across a relatively short distance to an adjacent support member.

Additional support members 144 can be placed within the perimeter of the foundation assembly (FIG. 1).

Figure 5:
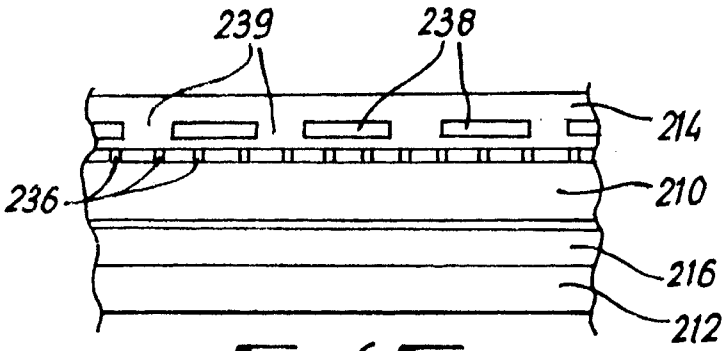
FIG. 5 shows, to an enlarged scale a plan view of the beam of FIG. 4.

A modified beam is illustrated in FIGS. 4 and 5.

A reinforced concrete beam, which is prefabricated in factory conditions, comprises an inverted T-section having an upstanding web 210 from the base of which project transversely webs 212 and 214 which are, respectively, outermost and innermost in use, that is the web 212 supports the outer skin of a wall to be built on the beam while the inner web 214 supports a cast in situ floor slab 215.

The floor slab 215 is cast on two layers of profiled polystyrene 246,248 laid at building ground level on a damp proof membrane 244. The lowermost layer 246 of polystyrene has a castellated top to accommodate any ground heave and the upper layer 248 has grooves 250 formed therein running in mutually perpendicular directions such that the concrete slab 215 cast on the upper surface of the polystyrene layer 248 has downwardly projecting ribs 252 therefrom arranged in a lattice formation. The ribs 252 can incorporate reinforcing bars 254 and healing or service ducts 256. The polystyrene layer 248 does not extend to the web 210 of the beam so that the concrete slab 215 when cast extends downwardly alongside the innermost face of the web 210 and rests on top of the innermost flange 214, that is the concrete slab has peripheral downwardly projecting edge region 258 the height of which is no greater than the height of the web and the base of which rests on the top of the flange.

The upstanding web 210 has a thickness which decreases in the upward direction while the upper and lower faces of the flanges are substantially horizontal. The end faces of the flanges also have a convergence upwardly to assist in removal of a beam from a mould in which it is cast in a position which is opposite to that shown in FIG. 4. A reinforcing fillet 216 is formed between the junction of the web 210 and the flange 212.

Steel reinforcement within the beam comprises a plurality of longitudinally extending reinforcing bars 218 at least some of which are pretensioned while the beam is being east. At spaced intervals along the length of the beam there are provided reinforcing links 220 each of which comprises a first horizontal upper section 222 extending From approximately the mid axis of the web towards the outer end of the outer or second flange 212 into a radiused section 224 joining the first upper section 222 with a second lower horizontal section 226 on which the longitudinal members 218 rest. At the end of the lower section 226 adjacent the second web 214 there is provided a further radiused section 228 leading to an inclined upwardly extending final section 230 which terminates short of the top off the web 210. Further longitudinally extending but smaller diameter reinforcing members 232, 234 are fixed to the upper horizontal section 222 and the upwardly extending section 230.

This embodiment is designed so that the floor slab 215 is keyed to the beam such that relative movement between the beam and the slab in the two mutually perpendicular horizontal axes parallel and transverse to the longitudinal axis of the beam are resisted.

This modification provides this by incorporating in the inner face of the web 210 a plurality of ribs 236 into which the concrete of the floor slab flows prior to the concrete setting.

Similarly, the upper face of the innermost flange 214 is provided with a longitudinally extending concave channel 238 again into which the concrete flows as the floor is being cast. The channel, as can be seen from FIG. 5 has transverse paritions 239 arranged at spaced intervals along its length. This channel 238 is equivalent to the channel 140 of the first embodiment illustrated in FIG. 3.

It is important to note that the upper level of the floor slab 215, since it is being cast within a ring of beams, is no higher than the upper face of the beam. In certain design situations it can be lower than the upper face of the web of the beam. The thickness of the floor slab can be less than the height of the web of the beam but once again it is important to note that at the inner face of the beam the floor slab extends downwardly onto the upper face of the inner flange. It is also important to note that as well as restraint against relative movement between the slab and the beam in two mutually perpendicular horizontal axis, the slab is restrainted against upward movement by building the inner wall 211 on top of the flange 210 such that is overlaps the edge of the slab 215.

I claim:

1. A structural beam comprising an upstanding web and a first flange at the base of the beam extending transversely of the web to at least one side of the beam, and an inner face of the web intended to face the interior of a structure to be built on the beam, wherein an upper face of the flange including surface irregularities comprising a longitudinal channel having transversely extending partitions formed at spaced intervals across the channel, the inner face of the web and upper face of the flange cooperating to define an interior surface of the beam, whereby a slab cast against said interior surface of the beam is keyed against movement relative to the beam by the surface irregularities.

2. A beam as claimed in claim 1, and comprising surface irregularities formed in the inner face of the web, the surface irregularities of the web including a plurality of ridges extending in a direction from the top to the bottom of the beam.

3. A building structure comprising a structural beam assembly comprising a plurality of beams as claimed in claim 2 arranged around the periphery of the structure, support means located in the ground and supporting the ends of the beams, sacrificial shuttering for a floor slab covering the area enclosed by the beam assembly and a cast in situ floor slab of a settable material covering the shuttering and contacting at least one of the inner face of the web of the beam and the upper face of an inwardly directed flange of the beam.

4. A beam as claimed in claim 1, in which a fillet is formed at the junction of the web and the flange which is intended to be outermost in use.

5. A beam as claimed in claim 1, in which reinforcement is provided within the beam and comprises a plurality of longitudinal extending members and a plurality of transverse link members each of which comprises an upper horizontal section extending into a second flange opposite the first flange, a radiused section in said second flange, a lower section extending across the base of the second flange from said radiused section to a further radiused section interconnecting the base section with an upright section extending towards the top of the web at an angle to the vertical.

6. A beam as claimed in claim 5, in which the longitudinal members are arranged against the upper and lower horizontal sections and the inclined upright section.

7. A beam as claimed in claim 6, in which the length of the flange which is outermost in use is greater than that which is innermost in use.

8. A building structure comprising a structural beam assembly comprising a plurality of beams as claimed in claim 1 arranged around the periphery of the structure, support means located in the ground for supporting the ends of the beams, sacrificial base shuttering covering the area enclosed by the beam assembly and a cast in situ floor slab of a settable material covering the shuttering and contacting at least one of the inner face of the web of the beam and the upper face of an inwardly directed flange of the beam.

9. A structure as claimed in claim 8, in which a reinforcing member extends inwardly from the joint between two beams at a corner of the structure into the floor slab.

10. A structure as claimed in claim 8, in which shuttering is placed at each joint between beam sections and concrete is cast into any void created by the facing ends of the beams and the shuttering.

11. A structure as claimed in any one of claims 8 to 10, in which the sacrificial base shuttering defines a plurality of channels extending in generally mutually perpendicular directions.

12. A structure as claimed in claim 4, in which reinforcing members are placed in each channel before concrete is poured therein.

* * * * *